US005752405A

United States Patent [19]

Gerst et al.

[11] Patent Number: 5,752,405

[45] Date of Patent: May 19, 1998

[54] AUTOMATIC CRIMPING TOOL

[75] Inventors: Michael Gerst, Worms; Tilo Sasse, Berlin; Jaroslav Zajicek, Frankfurt, all of Germany

[73] Assignee: The Whitaker Corporation, Wilmington, Del.

[21] Appl. No.: 432,311

[22] Filed: May 1, 1995

[30] Foreign Application Priority Data

Jun. 9, 1994 [GB] United Kingdom ..... 9411607

[51] Int. Cl.[6] ..... B21D 11/00; B21D 22/00; B21D 22/21; B21J 13/10

[52] U.S. Cl. ..... 72/312; 72/420; 72/350; 72/351

[58] Field of Search ..... 72/312, 313, 417, 72/420, 421, 350, 351; 29/753; 226/68, 73, 162, 163

[56] References Cited

U.S. PATENT DOCUMENTS

| | | | |
|---|---|---|---|
| 2,369,551 | 2/1945 | Feiler | 72/312 |
| 3,091,277 | 5/1963 | Schmitt | 72/312 |
| 3,883,978 | 5/1975 | Schmidt et al. | 29/753 |
| 5,353,625 | 10/1994 | Hoshino et al. | 29/753 |

FOREIGN PATENT DOCUMENTS

| | | | |
|---|---|---|---|
| 0652601 | 11/1937 | Germany | 72/351 |
| 0747577 | 7/1980 | Russian Federation | 72/350 |

*Primary Examiner*—Lowell A. Larson
*Assistant Examiner*—Rodney Butler
*Attorney, Agent, or Firm*—Driscoll A. Nina

[57] ABSTRACT

An automatic crimping tool having a crimping mechanism and a carrier strip feed mechanism where the crimping mechanism includes a vertically slidable ram with crimping dies and a spring loaded terminal clamping bar mechanism that has a slidable spring loaded clamping bar that presses a terminal against an anvil during the downward stroke of the ram by way of a pivotable hook mechanism attached to the clamping mechanism that engages with a pin of the bar to lift the bar off the terminal during the upward ram stroke after crimping, thereby considerably increasing the crimping cycle speed, the crimping mechanism further includes a depressor attached to the ram that depresses the carrier strip feeding mechanism in sync with the movement thereof, such that the carrier strip is pushed below the height of the anvil just prior to crimping so that bending of the carrier strip and tilting of the terminal is avoided, ensuring a high crimp quality, the feeder mechanism having a double acting motor that effectuates advance and retreat of the feeder arm that is positioned below the carrier strip guide surface such that a wire for crimping can be translated over the carrier strip directly above the terminal.

15 Claims, 12 Drawing Sheets

AUTOMATIC CRIMPING TOOL

BACKGROUND OF THE INVENTION

1. Field of the Invention

This invention relates to an automatic tool for crimping electrical conducting wires to stamped and formed contacts fed on a carrier strip.

2. Description of the Prior Art

A typical crimping tool comprises a crimping die and corresponding anvil, the die moving up and down with respect to the anvil to crimp a crimping barrel of a contact over bared ends of an electrical conducting wire. Such a crimping tool would further comprise a feed mechanism for engaging holes in a carrier strip to which the contacts are still attached prior to crimping, to advance the contacts over the anvil after each crimping cycle. The feed mechanism typically comprises a ratchet arm attached to a slider moving back and forth, the ratchet arm pivotally mounted to the slider and biased by spring means such that the engaging tooth is biased against the carrier strip and snaps into the hole for subsequently pushing the carrier strip forwards.

The crimping tool is usually positioned within a lead-making machine which has a wire griper and mover that moves the wire of a lead to a position above and aligned with the terminal, subsequently moving the lead over the terminal for it to be crimped therewith.

When the terminal is fed onto the anvil, and the die is in it's downward stroke, a resiliently mounted bar attached to the moving part clamps down the terminal prior to the crimping operation such that it is held firmly seated against the anvil, the terminal subsequently being cut away from the carrier strip and then the wire is crimped thereto. This resiliently mounted bar also serves to ensure ejection of the crimped terminal from the die which has quite a narrow neck sometimes causing the crimped terminal to remain stuck therein.

One of the problems with the prior art, however, is that the resiliently mounted bar has quite a long spring part as it needs to clamp the terminal prior to cutting and crimping operations, which therefore means that the terminal is clamped an unnecessarily long time during the upwards stroke of the die. It would be desirable to release the terminal as quickly as possible after the crimping operation such that the carrier strip can be fed forwards and the next crimping cycle can begin.

A further problem with the prior art, is that the adjustable crimping dies (there is one die for crimping the conducting strands and one die for crimping the strain relief crimp arms over the insulation of the wire) are mounted to an applicator whereby the crimping dies must be removed from time to time as they wear, and this cannot be done without removing the applicator first from the machine. It would therefore be desirable for having more simple means of removing the crimping dies without removal of the applicator from the machine.

A further problem with the prior art feed mechanism is that the wire cannot be fed by the gripper over the carrier strip, but rather has to be axially aligned with the die first and them moved in the direction of the terminal thereover. The carrier strip rachet arm is positioned above the carrier strip thereby preventing movement of the wire therepast directly over the carrier strip. The latter therefore requires an extra movement in positioning of the wire above the crimping barrels of the terminal. It is desirable to reduce the number of movements of the wire, as this could once again lead to the acceleration of the crimping process. It would therefore be desirable to be able to feed the wire directly over the carrier strip and above the crimping barrel of the terminal in a single linear movement.

It would also be desirable to have a more effective means of controlling or varying the feed and return speed of the feed mechanism in a reliable and cost-effective manner.

A further problem with the prior art, is that the carrier strip slides over a guide surface of the feed mechanism which is at a slightly higher level than the anvil such that the terminals can be positioned above the anvil prior to clamping thereagainst. During the clamping and subsequent crimping, the crimping barrel is however slightly tilted due to the terminal being bent down from the level of the carrier strip on the feed guide to that of the anvil. The tilted crimp barrels reduce the quality of the crimp and therefore the electrical properties between the wires and the terminal. It would therefore be desirable to ensure that the crimping barrel is not tilted with respect to the plane of symmetry of the die.

SUMMARY OF THE INVENTION

It is therefore an object of this invention to provide a crimping tool for a reliable and rapid automated crimping of stamped and formed terminals to conducting wires.

It is an object of this invention to provide a crimping tool with a reduced cycle time, in particular reducing the clamping time of the terminals against the crimping anvil during the upwards stroke of the crimping die.

It is a further object of this invention to reduce the cycle time of a crimping tool, in particular reducing the number of movements of a wire fed to a terminal for crimping thereto.

It is a further object of this invention to provide a fully automated crimping tool that has a carrier strip feed mechanism with a reliable and easily controlled feed and return mechanism that can operate at high speeds.

It is a further object of this invention to provide a crimping tool for fully automated crimping of terminals to wires, the terminals being fed on a carrier strip, such that tilting of the terminal with respect to the plane of symmetry of the crimping die, during crimping, is avoided.

DETAILED DESCRIPTION OF THE PREFERRED EMBODIMENT

Figure 1A:
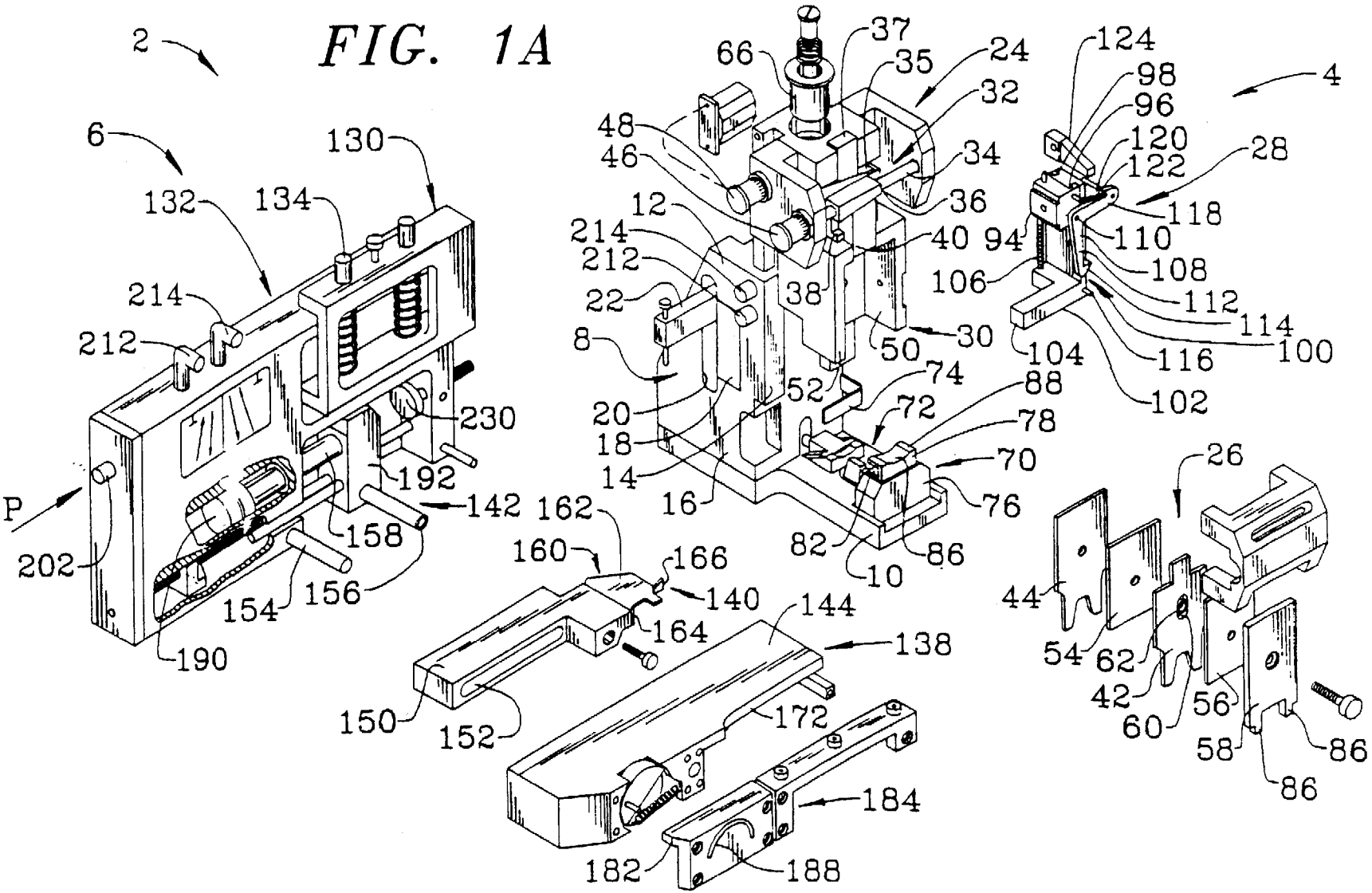
FIG. 1*a* is an exploded isometric view of a crimping tool.
Figure 1B:
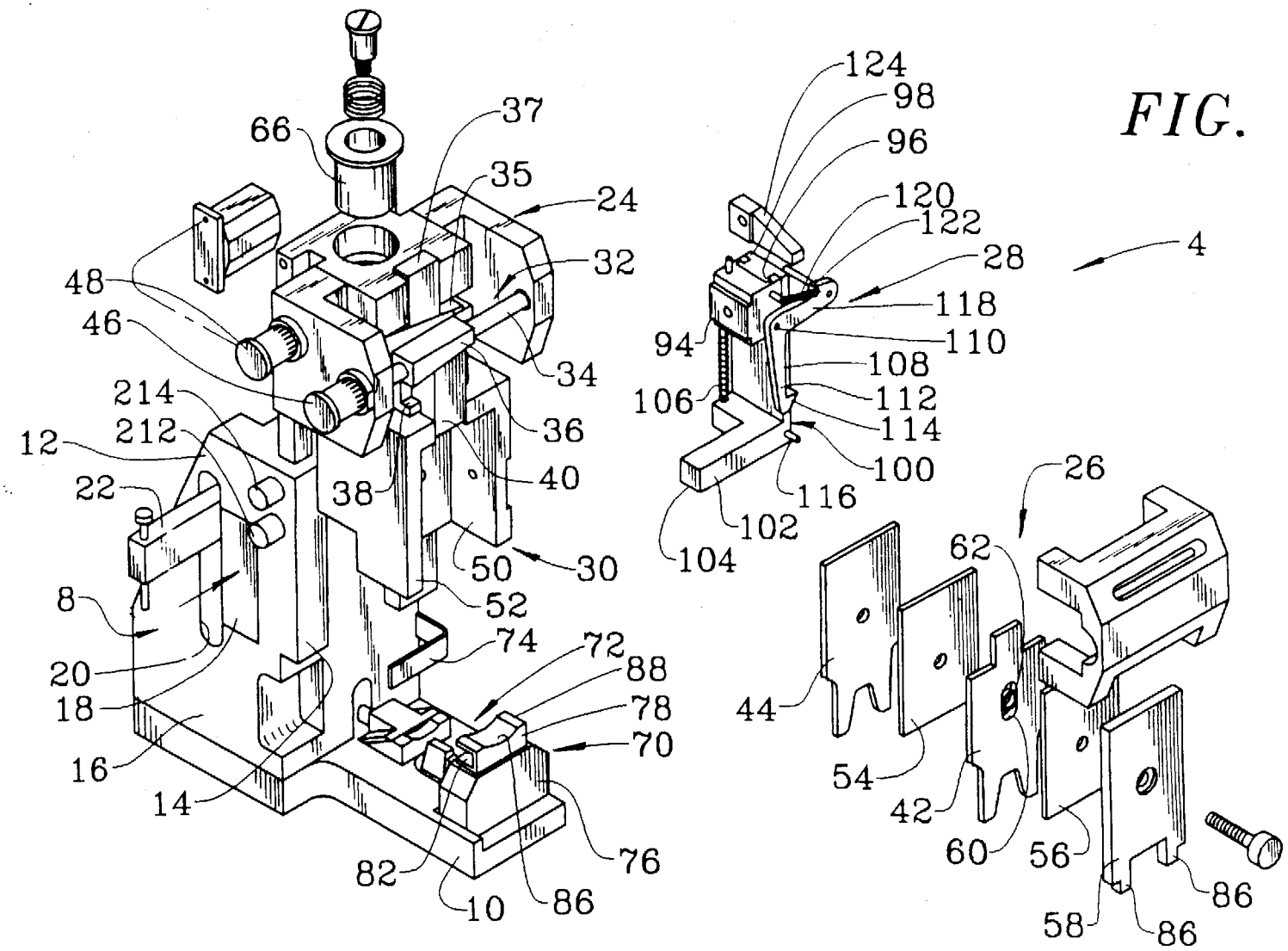
FIGS. 1*b*, 1*c*, 1*d*, and 1*e* are more detailed views of parts of FIG. 1*a;*

Referring first to FIG. 1, a crimping tool generally shown at 2 comprises a crimping mechanism 4 and a carrier strip feed mechanism 6.

The crimping mechanism 4 comprises a fixed housing 8 having a base plate 10 and a vertical structure 12 having vertical ram guides 14. The vertical structure 12 further comprises a side wall 16 having a mounting surface 18 and a long vertical slot 20 for receiving a depressor arm 22 therethrough. The crimping mechanism 4 further comprises a vertically slidable ram 24 comprising a crimping die 26, a terminal clamping bar device 28, a ram housing 30 and a crimp height adjustment head 32.

Figure 1C:
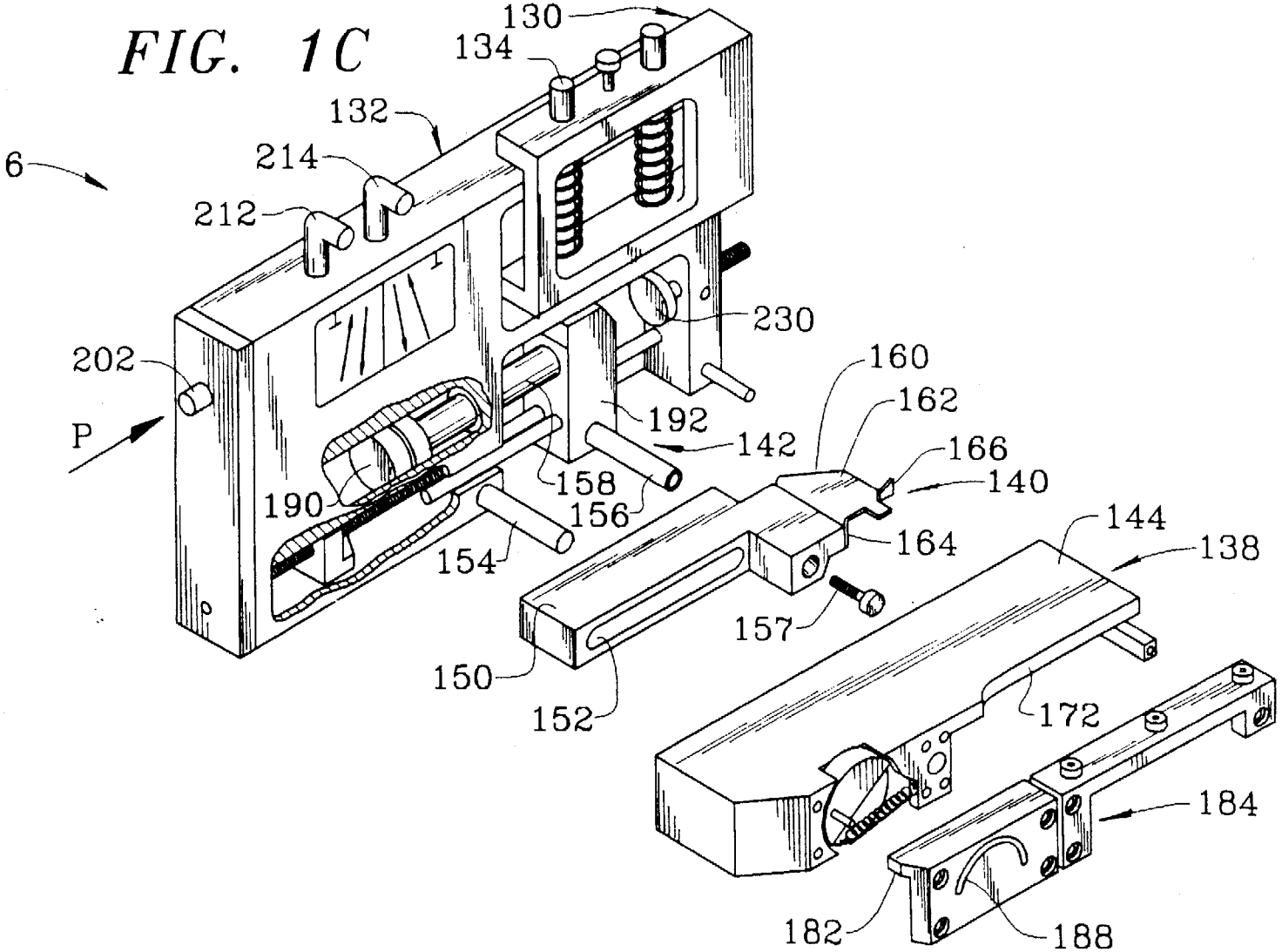
Figure 1D:
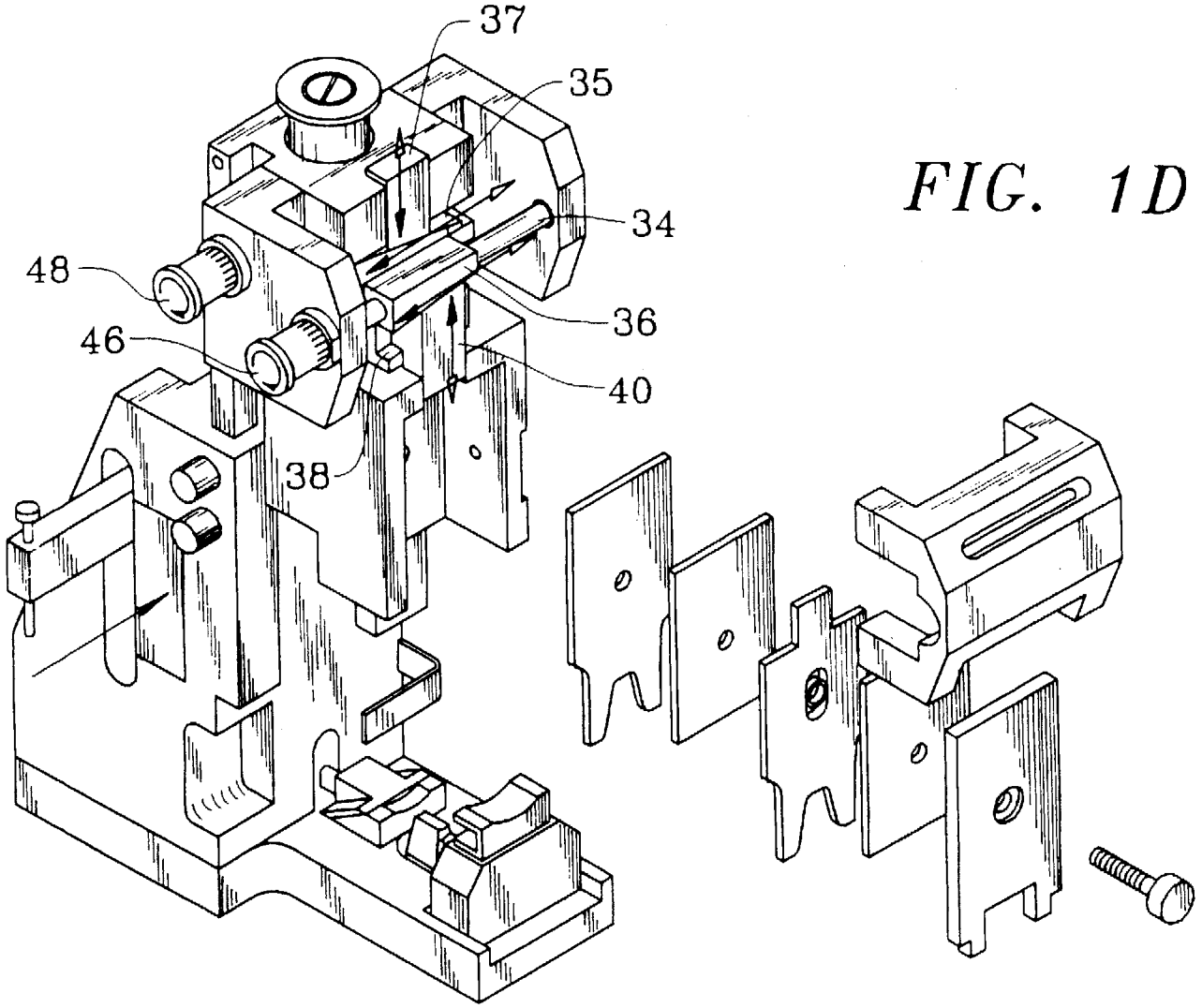

The crimp height adjustment head 32 comprise a threaded spindle 34 along which a height adjustment block 36 is translated, the block 36 having an inclined channel 38 in which engages a complementary male slide of a vertically slidable crimp height adjuster 40 which moves a corresponding plate 42, 44 of the crimping die 26. The spindles 34 are rotated by corresponding adjustment knobs 46, 48 having graded scales thereon for accurately adjusting the desired crimping die height. The crimp die height is therefore adjustable in a continuous manner as opposed to an indexed manner of the prior art, thereby allowing a finer adjustment of the crimp height, as best seen in FIG. 1*d*.

In the embodiment of FIG. 1, the crimping die 26 is shown comprising two crimping plates 42, 44, the first one for crimping strain relief arms 46 (see FIG. 5) of a corresponding terminal, and the second crimping plate 44 is for crimping the bared conductor end of the conducting wire 45 with the wire crimping arms of the terminal 47. The ram housing 30 has a recess 50 extending from it's front face 52 for receiving the crimping plates 42, 44, intermediate plates 54, 56, and front plate 58, which are all bolted thereto. The front crimping plate 42 comprises a vertically disposed oblong slot 60 within which a bushing 62 of slightly greater thickness than the plate can slide. This allows the front crimping plate 42 to move vertically with respect to the other crimping plates when bolted to the housing 30 such that the relative height between crimping plates 42, 44 and the total height of the crimping die 26 can both be adjusted separately for adapting to various crimp height requirements. The front loading of the crimping dies allows rapid and easy removal and replacement thereof, for example if they are worn or damaged.

Figure 4:
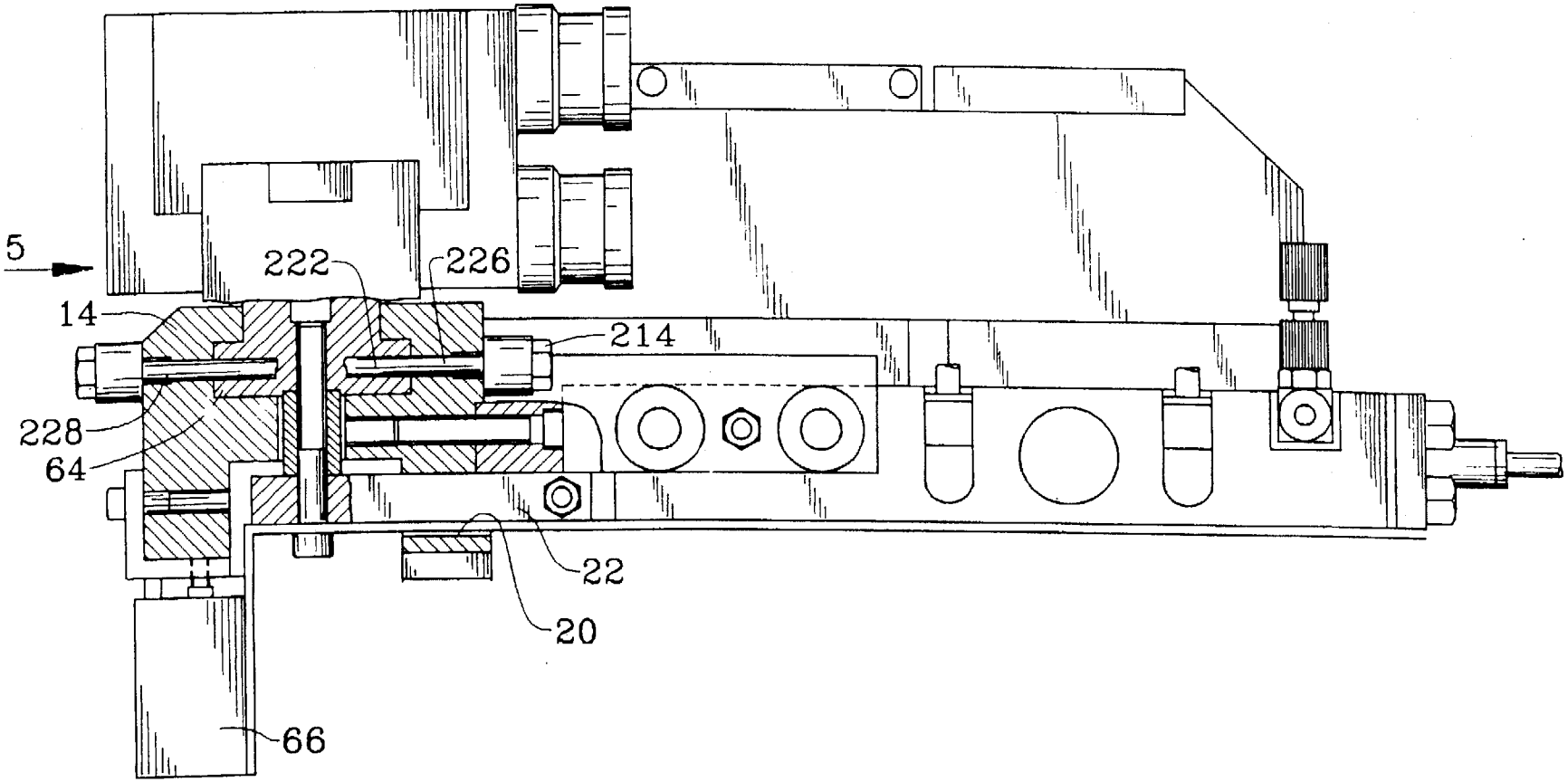
FIG. 4 is a partial cross-sectional view of the top of the crimping tool.

The ram 24 further comprises a T-shaped slide (also see FIG. 4) 64 that cooperates with the vertical U-profiled guides 14 of the vertical housing structure 12. The ram 24 is attached to a press (not shown) via a flanged bushing 66 that is bolted to the ram and spring loaded to allow limited upwards vertical movement of the bushing 66. Advantageously, this is why there is no play between the crimp height adjuster and the press, thereby reducing the noise level during the crimp stroke. FIG. 4 also shows the depressor arm 22 rigidly connected to the T-shaped slide 64 of the ram through a slot in the vertical housing 12. A counter 68 to count the number of crimping cycles is also rigidly attached to the ram whereby a switch is activated on every downwards or upwards movement of the ram to increment the counter.

Fixed to the base 10 of the housing 8, is a cutting device 70 for cutting the terminal away from the carrier strip during the crimping operation, and an anvil 72 against which the crimping portion of the terminal 47 rests against during the crimping operation.

Figure 5:
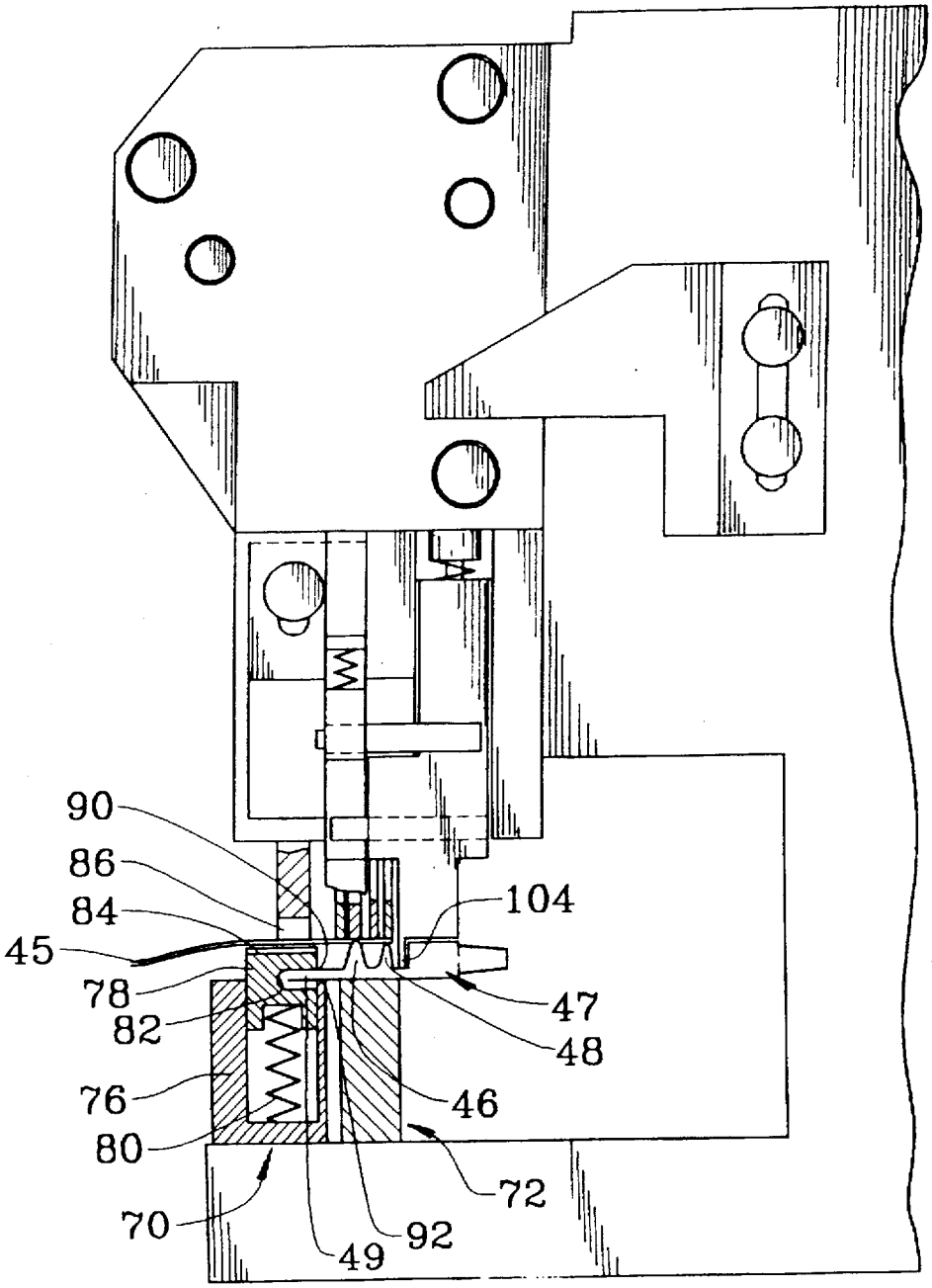
FIG. 5 is a partial cross-sectional view of one end of the crimping tool as seen in the direction of arrow 5 of FIG. 4.

Referring to FIGS. 1 and 5, the cutter 70 is shown comprising a fixed member 76 and a vertically slidable cutter 78 that is mounted by spring means 80 within the fixed part 76. The cutter 78 comprises a U-shaped slot 82 for slidably receiving the carrier strip 49 of the terminal therethrough. During the downward stroke of the crimping operation, the wire 45 is positioned above a concave recess 84 of the cutter 78. The front plate 58 of the crimping die 26 has a pair of legs 86 flanking the wire 45 and which come into abutment with top surfaces 88 flanking the concave recess 84 of the cutter. The cutter 78 is thus pushed into the recess 77 of the fixed part 76, thereby shearing away the carrier strip 49 from terminal 47 by engagement of corner edges 90, 92 of the cutter and fixed part respectively. The wire 45 is subsequently moved downwards between the crimping arms 46, 48 which are then crimped thereover by the crimping plates 42, 44 respectively.

Prior to cutting the terminal 47 away from the carrier strip 49, the terminal 47 is resiliently clamped against the anvil 72 by the clamping bar mechanism 28. Referring to FIGS. 1, 2, 3 and 8, the terminal clamping mechanism 28 will now be described in detail. The terminal clamping device 28 comprises a mounting portion 94 which is bolted to the ram housing 30, the mounting portion 94 comprising a T-shaped slide recess 96 for vertically slidably receiving a T-shaped slide 98 of a movable portion 100. The movable portion 100 further comprises a clamping bar 102 orthogonal to the vertical slide 98 and comprising a clamping finger 104 for clamping the terminal 47 against the anvil 72 as shown in FIG. 5. The movable portion 100 is biased resiliently downwards from the fixed portion 94 by a coil spring 106 therebetween. The terminal clamping mechanism 28 further comprises an L-shaped catch 108 pivotally attached via an axis 110 to the fixed portion 94. The L-shaped catch comprises a first arm 112 having a latching hook 114 for engaging a pin 116 projecting from the movable portion 100, and a second arm 118 resiliently connected via a coil spring 120 to the fixed portion 94, the arm 118 having a stop pin 122 engageable against a fixed stop member 124 that is rigidly fixed to the crimp mechanism housing 8.

Figure 8:
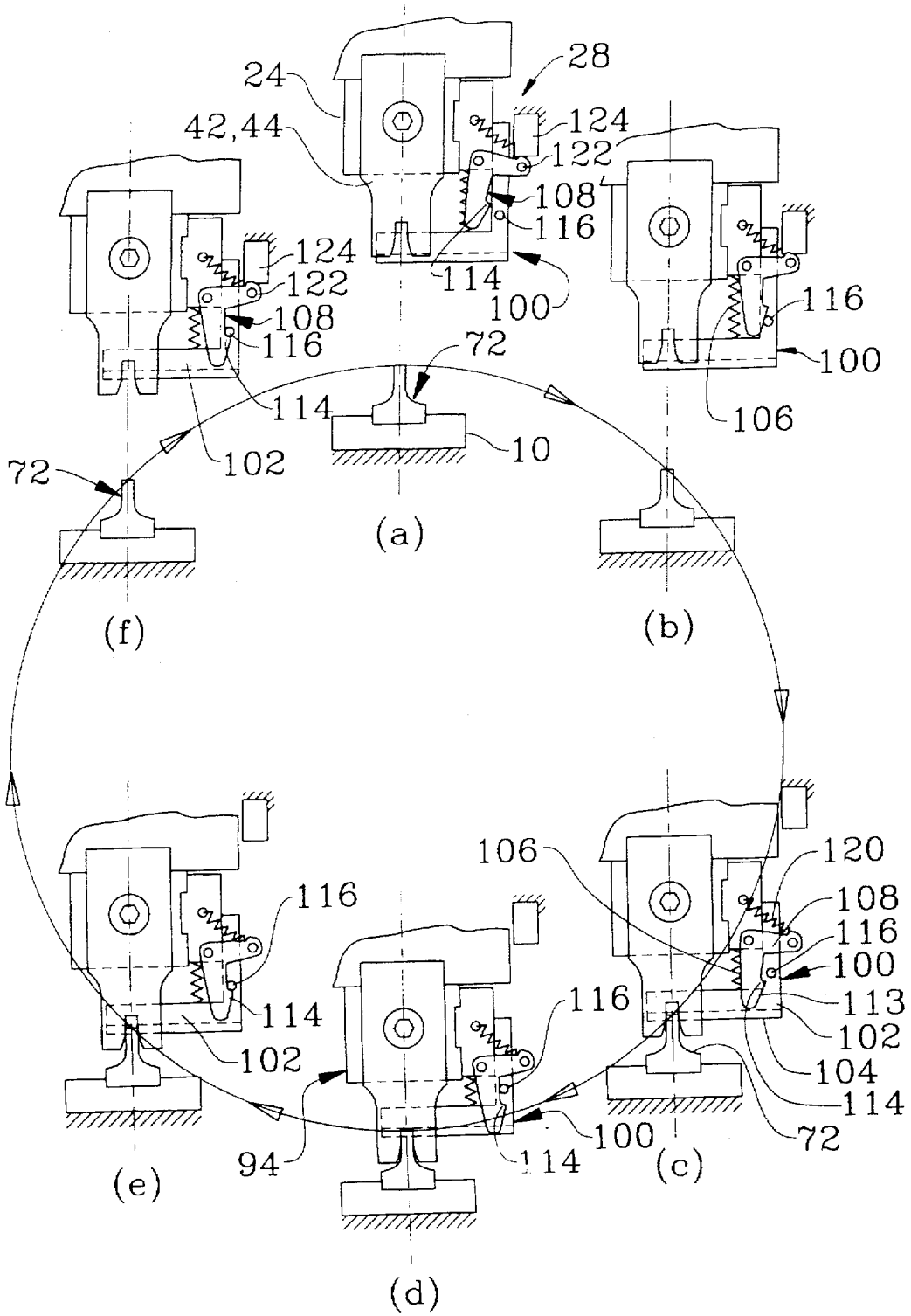
FIG. 8 is a series of front views of the crimping tool depicting movements of the spring loaded clamping bar during one cycle of the crimping stroke.

Referring to FIG. 8, functioning of the terminal clamping device 28 will now be described for one up-and-down cycle of the ram 24. At position A, the ram 24 is at top dead centre position, and the catch 114 of the pivot arm 108 is disengaged from the pin 116 of the movable portion 100 which is therefore biased to it's lowest position by the spring 106 as shown in position B. Position C shows the clamping bar 102 (i.e. the clamping edge 104) having engaged against the terminal 47 pressing it against the anvil 72 prior to the cutting operation of the carrier strip therefrom. The latter is the reason for requiring a long spring 106 and relatively large vertical movement of the movable part 100. In position C the crimping is almost completed and the tapered end 113 of the hook 114 has been cammed over the pin 116, whereby the spring 120 provides resilient opposition to pivoting in the clockwise direction of the catch 108.

In position D, the ram is at bottom dead centre and the crimping operation is complete, whereby the movable part 100 and the fixed part 94 are compressed closely together and the hook 114 is below the pin 116. During the upward stroke, position E shows engagement of the hook 114 with the pin 116 shortly after bottom dead centre such that the clamping bar 102 lifts off from the terminal 47. The short downward movement of the clamping bar between positions D and E is necessary and sufficient to eject the crimped terminal from the crimping plates 42, 44 as they could remain stuck thereto. From position E to position F which is just prior to top dead centre, the clamping bar 102 is thus cleared from the anvil 72 thereby allowing the terminated terminal 47 to be removed and the carrier strip to be advanced to position a further terminal 47 over the anvil 72. The catch 108 therefore reduces the time during which the terminal is clamped to the anvil thereby allowing an increase in the overall crimping cycle speed. Moving from position F to position A, the stop pin 122 engages the fixed stop 124 causing clockwise rotation of the catch 108 such that the hook 114 disengages from the pin 116 thereby releasing the clamping bar 102 for recommencement of the cycle.

Figure 1E:
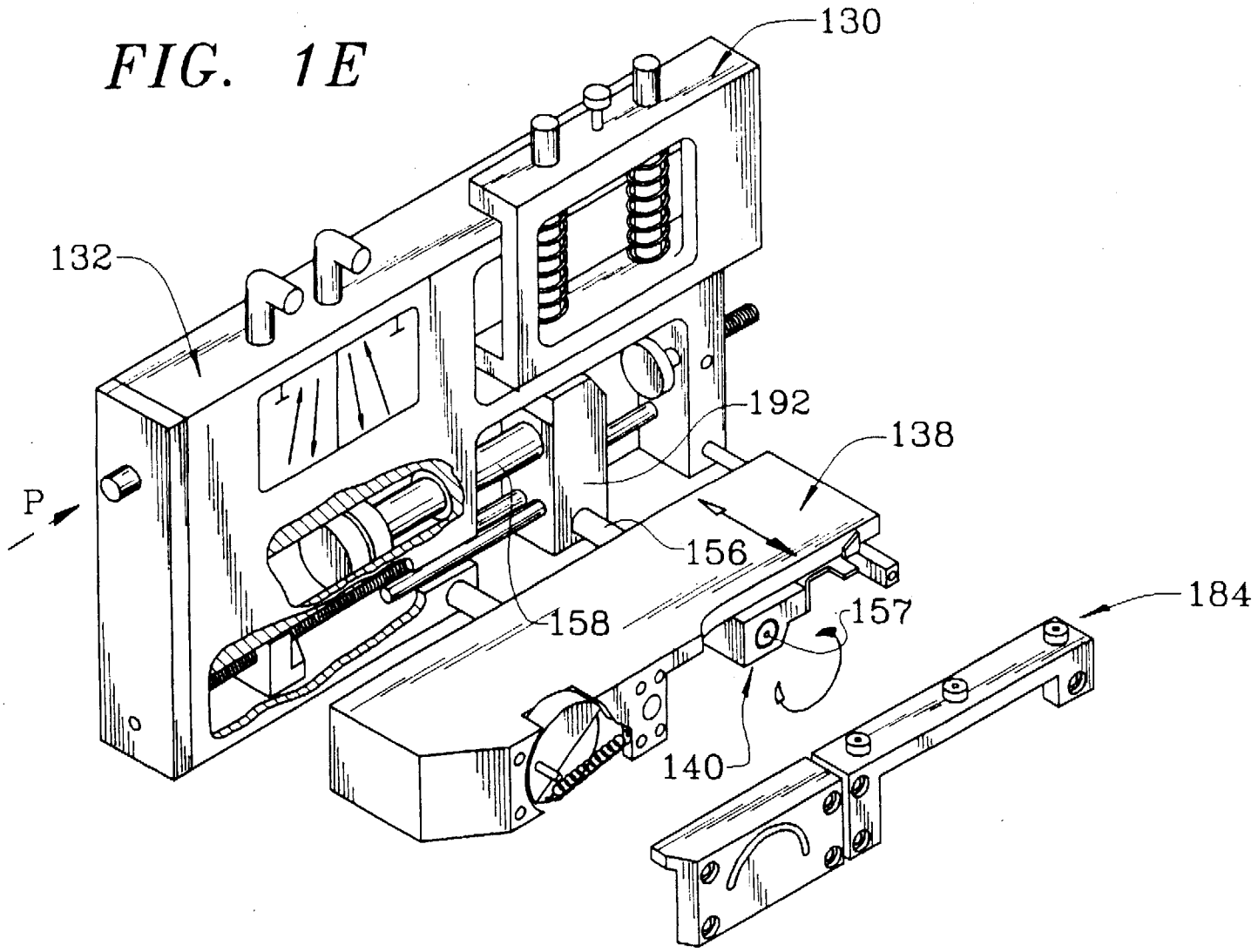
Figure 2:
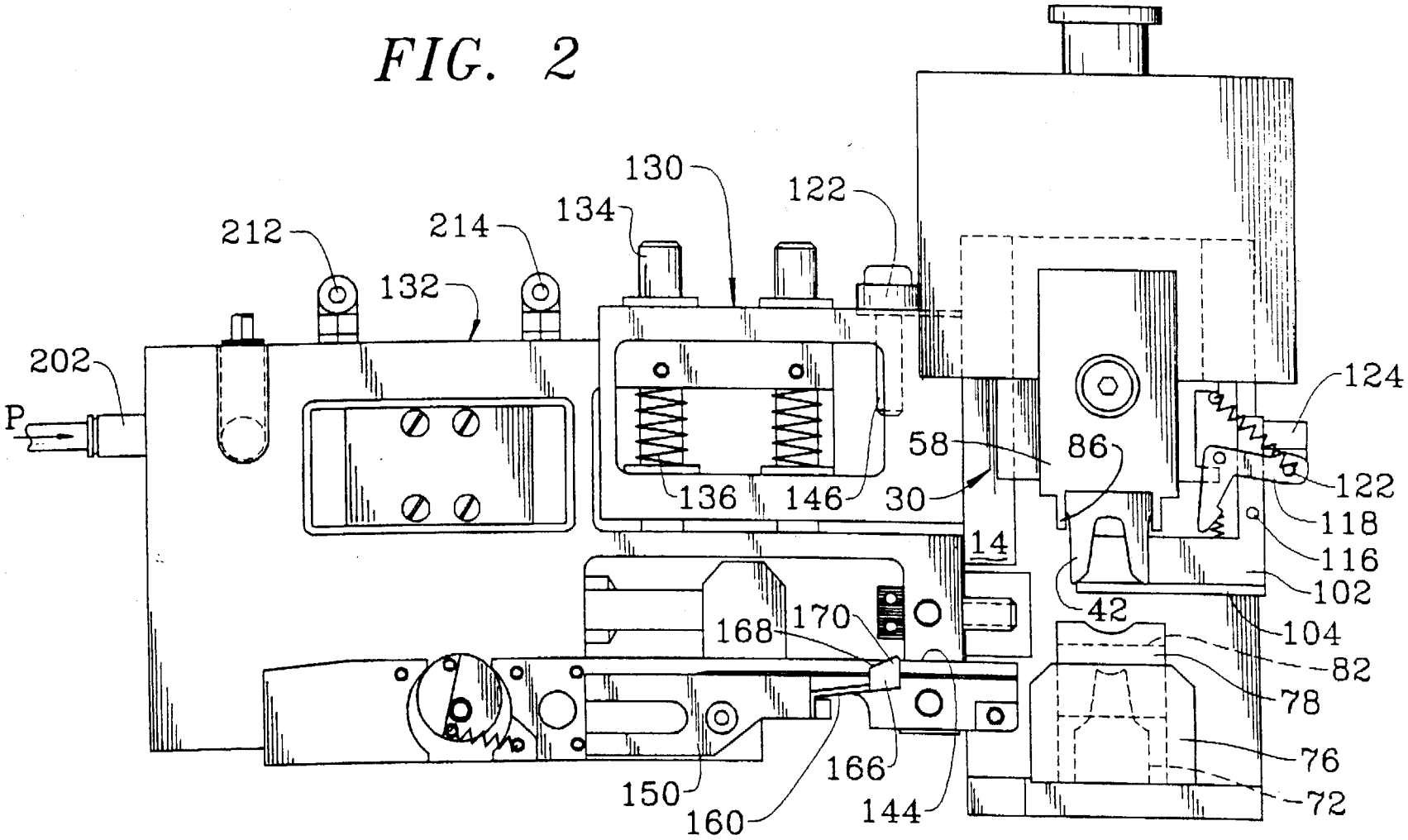
FIG. 2 is a front view of the crimping tool with a feed mechanism cover removed, and the crimping die in top dead centre position.
Figure 3:
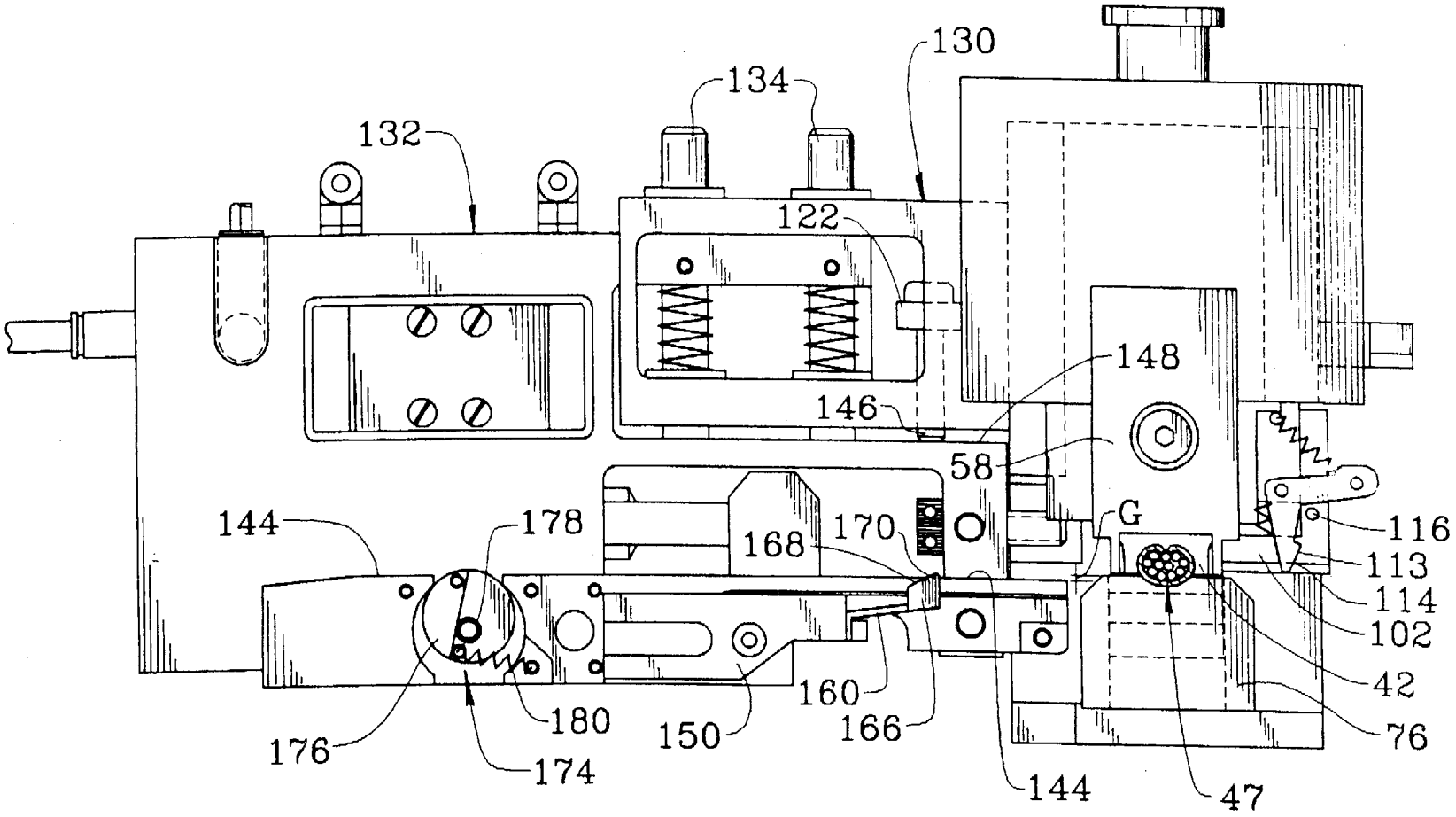
FIG. 3 is a similar view to FIG. 2 but with the crimping die in bottom dead centre position.

Referring now to FIGS. 1, 2 and 3, the carrier strip feeder mechanism 6 will now be described in detail. Looking first at FIGS. 1A and 1C, the feeder mechanism 6 comprises a fixed mounting block 130, a vertically movable housing 132 attached via guide rods 134 and compression springs 136 to the mounting block 130, a carrier strip guide plate 138 fixedly attached to the housing 132, and a carrier strip feeder arm 140 horizontally slidable with respect to the housing 132 by a pneumatic actuation device 142.

The mounting block 130 of the feeder mechanism 6 is rigidly bolted against the mounting surface 18 of the crimp mechanism housing 8. The feeder mechanism housing 132 is however resiliently biased upwards by the springs 136 with respect to the mounting block 130 such that an upper guide surface 144 of the guide member 138 is positioned in an uppermost position for feeding the carrier strip and terminals into the crimping mechanism cutter slot 82 and over the anvil 72 respectively. On the downward stroke of the crimping ram 24, just prior to the bottom dead centre position, a stop rod 146 of the depressor 22 engages a surface 148 of the housing 132 thereby depressing the carrier strip guide surface 144 slightly below the upper surface of the anvil 72 by distance G as shown in FIG. 3. The latter prevents bending of the carrier strip when the terminal 47 is pressed against the anvil 72 due to the fact that the anvil is lower than the carrier strip guide surface 144 during feeding. Bending of the carrier strip causes slight tilting of the terminal with respect to a vertical plane which impairs the crimping quality as the crimping arms 46, 48 are not symmetrically engaged by the crimping plates 42, 44. Lowering of the surface 144 during the crimping stroke therefore allows the level of the carrier strip to be at the same level as the anvil thereby preventing tilting of the terminal. Furthermore, in the case of a stroke of ram 24 occurring without having a terminal loaded therein, the ram is prevented from falling down upon the anvil 72, thereby protecting the crimp indentor and anvil from damage as the depressor 22 arrives first against surface 148 of housing 132. The depressor rod 146 can merely be a threaded bolt for rapid and easy adjustment of the depression stroke of the housing 132.

The feeder arm 140 and the guide member 138 will now be described. The feeder arm 140 comprises a slide mount 150 having a horizontal oblong slot 152 through which a guide pin 154 is inserted and supported, the guide pin 154 rigidly attached to the housing 132. Proximate a forward end of the slot 152, the slide mount 150 and the guide member are together adjustably bolted to a pin 156, by adjusting bolt 157, attached to a horizontally actuated piston rod 158 for effectuating the advance and retreat movements of the feeder arm 140. The adjusting bolt 157 serving to effect inward and outward movement of the guide member 138 (as shown in FIG. 1*e*) in order to accommodate carrier strip-terminal combinations of different widths, thereby providing for quick and easy conversion of the machine in order to crimp different terminal configurations. The feeder arm further comprises a resilient hook member 160 that is a resilient stamped and formed unitary part comprising a horizontal base plate 162, a mounting plate 164 orthogonally bent therefrom for bolting the hook member 160 to the slide mount 150; and upstanding from the base plate 162 is a hook 166 having a rearwardly facing tapered edge 168. The guide member 138 is mounted over the feeder arm 140 whereby the hook 166 is adjacent a recessed front edge 170 of the guide member 138. The tip 170 of the hook 166 projects beyond the upper surface 144 when engaged in a hole of the terminal carrier strip. During the retreat movement of the feeder arm 140, the tapered rearward surface 168 of the hook 166 forces the tip of the hook 170 out of the carrier strip hole whereby the resilient plate 162 allows biasing of the hook 166 downwards. Proximate the rearwardmost position the hook 166 snaps into the preceding hole of the carrier strip, whereby the feeder arm 140 can then be advanced such that the hook 166 pushes the carrier strip forward such that a new terminal is presented to the crimping machine.

The simple unitary hook member 160 is not only cost-effective to manufacture due to the stamping and forming out of a sheet metal plate, but also incorporates the hook and spring functions within the same part. Furthermore, due to the positioning of the feeder arm 140 below the guide member 138, a wire being transported to the crimping mechanism can be passed over the carrier strip in a single translational movement to a position directly over the terminal. This is because the feeder arm does not extend from above the carrier strip but is rather placed below it.

In order to prevent rearwards movement of the carrier strip during the retreat action of the feeder arm 140, an eccentric brake 174 is positioned below the carrier strip pivotally attached to the guide 138. The eccentric brake 174 comprises a disc 176 pivotally mounted via an axle 178 that is off-centre with respect to the disk 176. A tension spring 180 attempts to rotate the disk 176 in the anti-clockwise direction as viewed in FIG. 3. Due to the eccentric, the disc 176 tends to protrude beyond the upper guide surface 144 thereby applying pressure against the carrier strip which is pushed against an upper surface 182 that is part of the guide member cover 184 as shown in FIG. 1C. The cover 184 is rigidly bolted to the guide member 138. If rearward movement of the carrier strip is attempted, the disc 176 will tend to rotate in anti-clockwise position, thereby protruding even further above the guide surface 144 and causing the carrier strip to further wedge itself between the cover surface 182 and the disk 176. This self-locking feature thereby prevents rearward movements of the carrier strip without necessitating a strong spring mechanism, thereby allowing the braking system to be relatively simple and cost-effective whilst producing very little resistance to forward movement of the carrier strip. The latter in turn reduces the forces required for advancing the carrier strip. A pin 186 which is fixed to the disk 176, projects through an arcuate slot 188 of the guide cover 184, for maintaining the disk in a position for receiving the carrier strip.

The feeder arm 140 is moved backwards and forwards by a double acting pneumatic piston 190 that is connected via the piston rod 158 to a block 192 to which the feed arm drive pin 166 is attached. The latter parts are members of the pneumatic motor 142; the functioning of which will now be explained in detail with the help of FIGS. 6 and 7.

Figure 6:
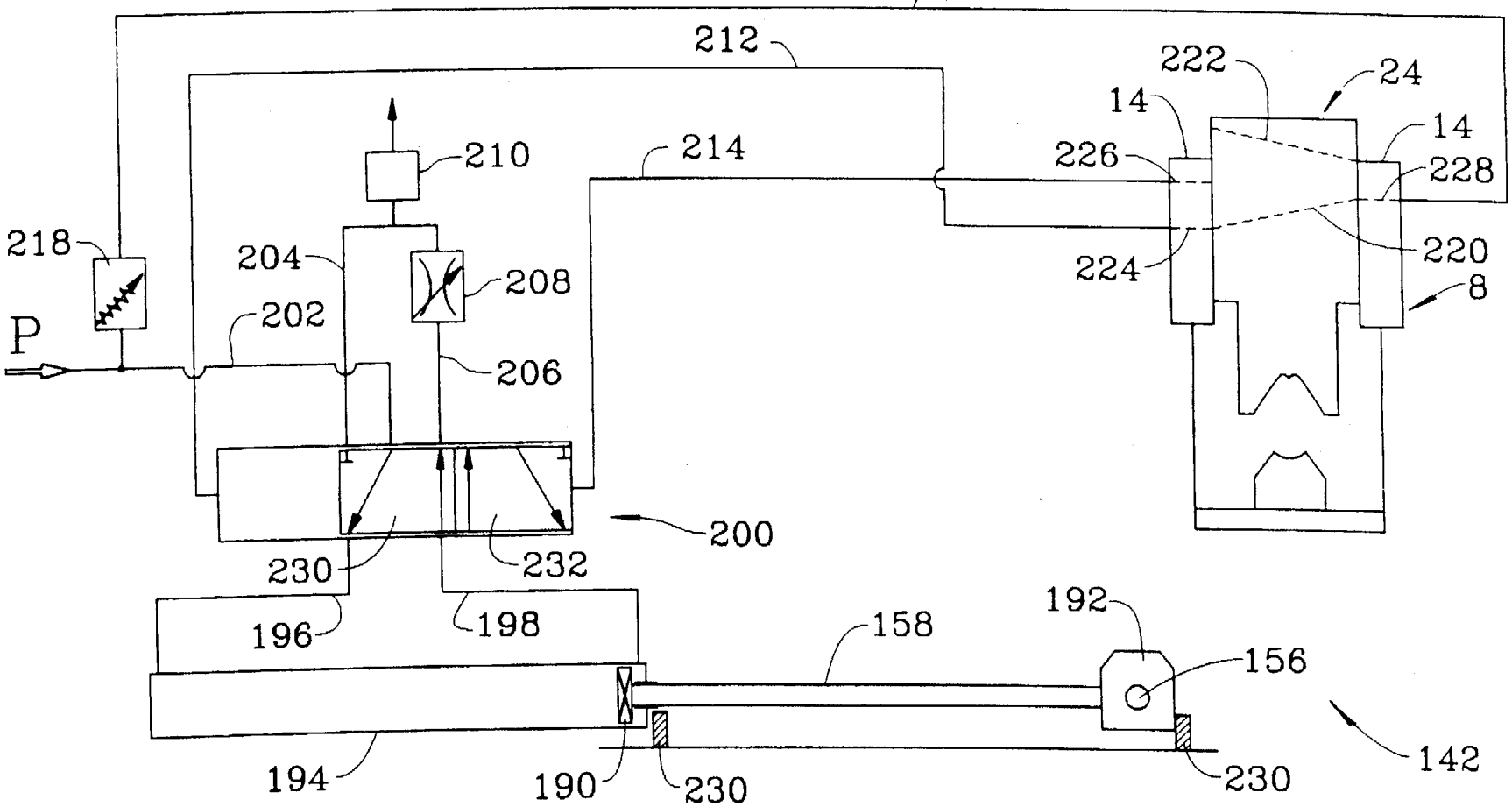
FIG. 6 is a schematic view of the pneumatic control system of the carrier strip feeder mechanism, shown in the advanced position.

Referring first to FIG. 6, a schema of the pneumatic control and drive circuit of the piston 190 is shown. The pneumatic motor 142 comprises a piston chamber 194 within which the piston 190 moves, piston chamber supply pipes 196, 198 for driving the advance and retreat movements respectively, the pipes 196, 198 being connected to a valve 200. Also feeding into the valve 200 is a pressure supply pipe 202 that is supplied with high pressure compressed air indicated by the arrow P. The supply pipe 202 supplies air either to the forward end or the rearward end of the piston chamber 194 through pipes 196, 198 respectively, to drive the piston either in advance or in retreat depending on the valve setting. Further pipes connected to the valve 200 are outlet pipes 204, 206 that allow evacuation of the rearward or forward parts of the piston chamber 194 through pipes 196, 198 respectively. The outlet pipe 206 that allows evacuation of air during the advance movement, has a variable flow regulator 208 such that the speed of the carrier strip advance can be regulated according to the desired speed. The advance speed can therefore be fine-tuned with this flow regulator 208. Both the retreat and advance outlets 204, 206 feed out to the atmosphere via a sound absorber 210 that reduces the noise level of the evacuated air.

Figure 7:
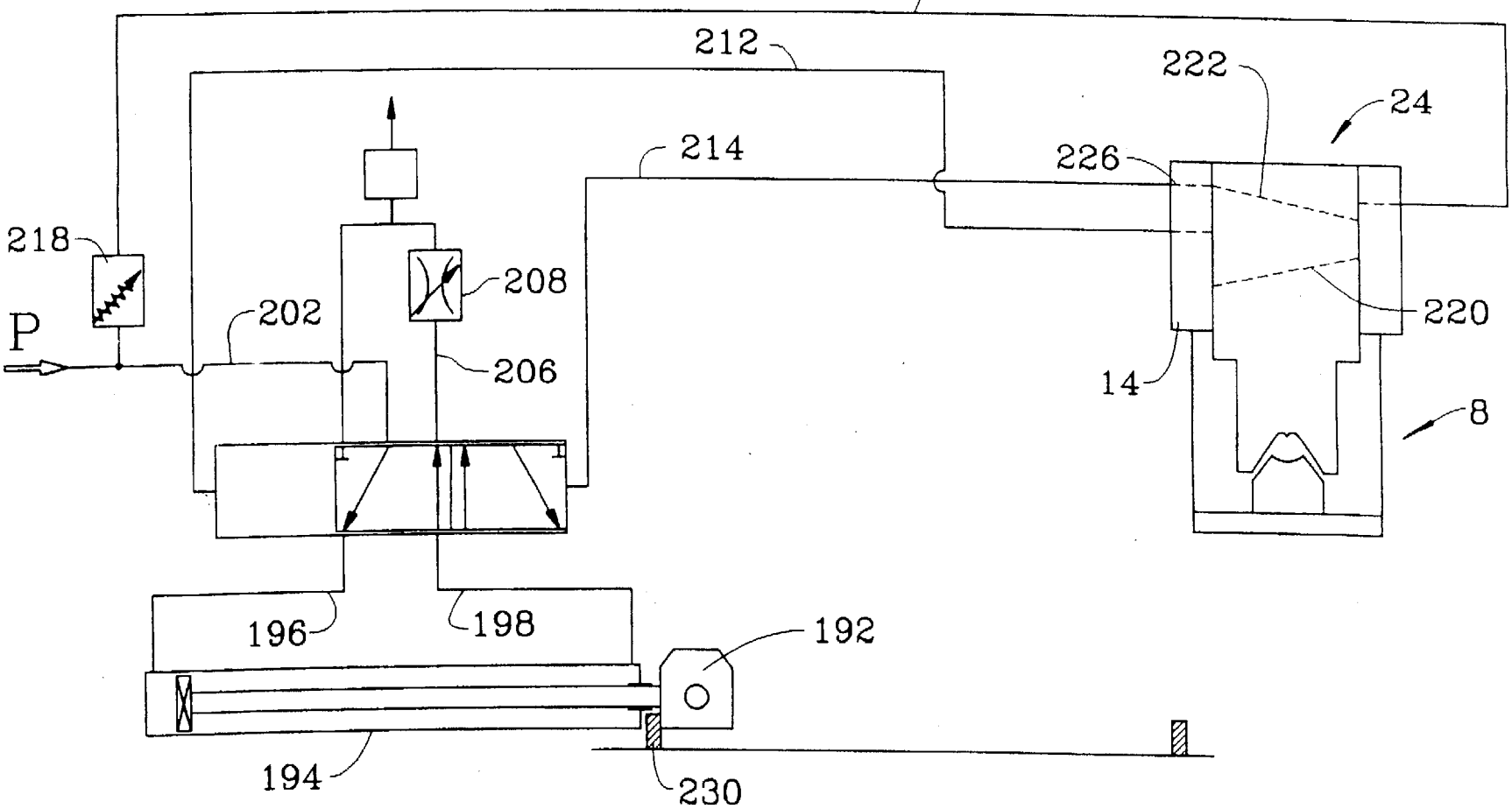
FIG. 7 is a schematic view similar to FIG. 6, but with the feeder in the retreated position.

The valve 200 has two positions, the advance position as shown in FIG. 6 and the retreat position as shown in FIG. 7. The position of the valve is being controlled by compressed air fed through advance and retreat control pipes 212, 214 respectively. The control pipes 212, 214 are supplied with air pressure through a control supply pipe 216 that is connected to the compressed air supply pipe 202 via a pressure regulator 218. Control of the valve does not require particularly high pressures as they are merely a control function. The pressure for advancing and retreating the piston however must be sufficiently high to attain the desired advance and retreat speeds of the feeder. The pressure regulator 218 therefore reduces the pressure to the control system to the minimum required level such that minimal air pressure loses are incurred at the control pipe switch as described hereafter.

Switching of the valve to the advance position as shown in FIG. 6 requires pressure being supplied in the control advance pipe 212. In a similar manner, switching the valve to the retreat position as shown in FIG. 7 requires pressure being supplied to the retreat control pipe 214. This switching of pressure between the control pipes 212 and 214 is effectuated by the vertical movement of the ram 24 with respect to the fixed housing structure 8. FIG. 6 shows the ram in top dead centre position ready for receiving a new terminal. The ram 24 comprises two air passages, the first one being the advance control air passage 220 and the other the retreat control air passage 222 that traverse the ram 24 from one of the housing structure guides 14 to the other housing structure guide. The housing structure guide 14 receiving the control pipes 212, 214 have air passages 224, 226 respectively. The guide 14 on the other side has an air passage 228 communicating with the supply control pipe 216. When in the top dead centre position as shown in FIG. 6, the air passage 220 communicates with the air passage supply 228 and causes pressure in the advance control pipe 212 to switch the valve 200 to the advance position. In bottom dead centre position as shown in FIG. 7, retreat of the feeder is effectuated due to communication of the passage 222 between the supply passage 228 and the retreat control passage 226. A portion of these air passages is shown in cross-section in FIG. 4 whereby air flows between the fixed passages 226, 228 to the passages 220, 222 in the ram across the sliding surface which therefore has a gap allowing some air to escape. This is the reason that a minimum of air pressure in the control supply pipe 216 is required to reduce the air pressure losses through the crimping mechanism. Additionally, due to the relatively accurate tolerances between the sliding parts that are held to improve the quality of the crimps produced, as there is less play between the ram 24 and the guide 14 which assures a correct vertical plane is established between the crimp indentor and the anvil 72, advantageously enabling the ram to also be used as part pneumatics of the device as air leaks can be maintained within acceptable values.

The two positions of the valve 200 are depicted in FIGS. 6 and 7 as positions 230, 232 whereby the arrows indicate the direction of flow and the interconnection of the pipes that are therebetween.

The provision of air passages in the ram and the housing provides for a very reliable and perfectly synchronized actuation of the advance and retreat movements in a simple and cost-effective manner. Furthermore, advance and retreat speeds can be controlled very effectively by simple variations of flow and pressure, and in particular not relying on spring return time as was the case with the prior art. The latter requires a particularly powerful piston to additionally counter the effect of the return spring. The movement range of the piston can be easily regulated by providing threadably adjustable slots 230 fixed to the feeding mechanism housing 132.

Advantageously therefore, the crimping cycle is faster due to the early release of the clamping arm against the terminal. Furthermore there are less steps required for movement of the conducting wire over the terminal due to the disposition of the carrier strip feeder arm below the carrier strip. Yet further is the provision of a double acting, easily controlled piston motor for accurately controlled advance and retreat movements of the feeder which also assists in increased rapidity. Yet advantageously, is the depression of the carrier strip guide surface below or at the anvil height such that tilting of the terminal is avoided during crimping, thereby increasing the quality of the crimp. Yet advantageously is the easily removable crimp end plates from the front of the crimping mechanism and also their finely adjustable height settings due to the tapered adjustment mechanism.

We claim:

1. A crimping tool comprising a crimping mechanism having a fixed housing to which an anvil is attached for supporting a terminal thereagainst during crimping, the tool further comprising a movable ram having a crimping die fixed thereto for crimping the terminal, the tool further comprising a terminal clamping bar device having a spring loaded clamping bar for clamping the terminal against the anvil, wherein the clamping bar device has a catch that grips onto the clamping bar during an upward stroke of the ram to limit the clamping time of the clamping bar against the terminal after the crimping thereof, in comparison with a downward crimping stroke of the ram.

2. The crimping tool of claim 1 characterized in that the clamping bar device is attached to the ram, the clamping bar being resiliently biasable with respect to the ram.

3. The crimping tool of claim 2 characterized in that the catch is spring loaded in the latching position with the clamping bar, and is releasable therefrom by provision of a stop member attached to the fixed housing and which engages the catch on the upward stroke.

4. The crimping tool of claim 3 characterized in that the catch is pivotly mounted to the clamping bar device.

5. A crimping tool comprising a crimping mechanism having a fixed housing to which an anvil is attached for supporting a terminal thereagainst during crimping, the tool further comprising a movable ram having a crimping die fixed thereto for crimping the terminal, the tool further comprising a carrier strip feed mechanism for feeding terminals attached to a carrier strip to the crimping mechanism, the carrier strip being fed over a guide surface of the feed mechanism, characterized in that the guide surface is depressible with respect to the anvil, and the crimping tool comprises a depressor arm engageable against the feed mechanism for depressing the guide surface during the downward crimping stroke of the tool, just prior to crimping.

6. The crimping tool of claim 5 characterized in that the depressor arm is attached to the ram.

7. The crimping tool of claim 5 characterized in that the carrier strip guide surface is mounted via springs to the feed mechanism.

8. A crimping tool comprising a crimping mechanism having a fixed housing to which an anvil is attached for supporting a terminal thereagainat during crimping, the tool further comprising a movable ram having a crimping die fixed thereto for crimping the terminal, the tool further comprising a carrier strip feed mechanism for feeding terminals attached to a carrier strip to the crimping mechanism, the carrier strip being fed over a guide surface of the feed mechanism, the feed mechanism further comprising a motor actively driving the movement of a feeder arm for engaging the carrier strip in a forward feed direction, characterized in that the motor also actively drives the feeder arm in a rearward direction opposed to the forward feed direction, the motor connected to a control mechanism for actuating the motor in the forward or rearward movement, the control mechanism comprising a switch having elements in the ram and elements in the housing that cooperate in an upward and a downward position of the ram for activating the forward and rearward movements of the feeder arm, wherein the switch comprises air passages through the housing that line up with air passages in the ram in the upward and downward positions for switching valves via air return pipes.

9. The crimping tool of claim 8 characterized in that the motor is pneumatic and comprises a double-acting piston, ad the control mechanism is a valve interconnected to a pressure supply pipe, and inlet and outlet pipes, to the piston.

10. The crimping tool of claim 8 characterized in that the feeder arm is positioned below the carrier strip guide surface with respect to the positioning of a carrier strip thereon.

11. The crimping tool of claim 9 characterized in that the switch is interconnected to the valve via air return pipes, and to a pressure source supply pipe.

12. The crimping tool of claim 11 characterized in that the feeder arm comprises a resilient unitary hook member for catching the carrier strip.

13. The crimping tool of any preceding claim characterized in that the crimping die is mounted in a recess extending from a front face of the ram that is easily accessible by an operator.

14. A crimping tool comprising a crimping mechanism having a fixed housing to which an anvil is attached for supporting a terminal thereagainst during crimping, the tool further comprising a movable ram having a crimping die fixed thereto for crimping the terminal, the tool further comprising a carrier strip feed mechanism for feeding terminals attached to a carrier strip to the crimping mechanism, the carrier strip being fed over a guide surface of the feed mechanism, the feed mechanism further comprising a motor actively driving the movement of a feeder arm for engaging the carrier strip in a forward feed direction, characterized in that the motor also actively drives the feeder arm in a rearward direction opposed to the forward feed direction, the motor connected to a control mechanism for actuating the motor in the forward or rearward movement, the control mechanism comprising a switch having elements in the ram and elements in the housing that cooperate in an upward and a downward position of the ram for activating the forward and rearward movements of the feeder arm, wherein the feeder arm comprises a resilient unitary hook member for catching the carrier strip.

15. The crimping tool of claim 14 wherein the feeder arm is positioned below the carrier strip guide surface with respect to the positioning of a carrier strip thereon.

* * * * *